US005468170A

United States Patent [19]

Kantor et al.

[11] Patent Number: 5,468,170

[45] Date of Patent: Nov. 21, 1995

[54] COLLECTOR'S MODEL DISINTEGRATOR PISTOL (CMDF)

[76] Inventors: Ellis Kantor, P.O. Box 410110, Creve Coeur; Daniel H. Heymann, HCO Services 12921 Nimes Dr., St. Louis, both of Mo. 63141

[21] Appl. No.: 307,157

[22] Filed: Sep. 16, 1994

Related U.S. Application Data

[62] Division of Ser. No. 144,244, Nov. 1, 1993, Pat. No. 5,389,027.

[51] Int. Cl.[6] ..... A63H 3/31; A63H 17/045

[52] U.S. Cl. ..... 446/23; 446/192; 446/405; 29/1.1; 164/35; 425/DIG. 57

[58] Field of Search ..... 425/DIG. 57; 164/34, 164/35; 29/1.1, 527.5; 42/54; 446/22, 23, 24, 180, 181, 192, 405, 406, 407, 473

[56] References Cited

U.S. PATENT DOCUMENTS

| | | | |
|---|---|---|---|
| 2,077,763 | 4/1937 | LeFever | 446/23 |
| 2,226,144 | 12/1940 | Smith | 446/23 |
| 2,440,177 | 4/1948 | Laidig | 446/23 |
| 2,479,598 | 8/1949 | Barber et al. | 164/34 X |
| 4,281,705 | 8/1981 | Jeney | 164/34 X |
| 4,561,491 | 12/1985 | Slack | 164/35 X |
| 5,195,226 | 3/1993 | Bornancini | 29/1.1 |
| 5,256,100 | 10/1993 | Wang | 446/473 |

FOREIGN PATENT DOCUMENTS

| | | | |
|---|---|---|---|
| 388116 | 10/1921 | Germany | 29/1.1 |
| 496553 | 11/1938 | United Kingdom | 446/23 |
| 656576 | 8/1951 | United Kingdom | 446/23 |

*Primary Examiner*—Robert A. Hafer
*Assistant Examiner*—D. Neal Muir
*Attorney, Agent, or Firm*—Henry W. Cummings

[57] ABSTRACT

In the present invention, a Collector's Model Disintegrator Pistol (CMDP) is formed from a pair of fight side and left side metal castings according to the investment or "lost wax" casting process. Preferably the left and right hand pistol sections are formed of suitable ornamental bronze, with a wide variety of possible bronze compositions being usable, depending upon cost and desirability of a particular finish. The bronze left and right sections are held together with counter sunk-screws instead of the crimped projections according to the construction made of U.S. Pat. No. 2,077,763. Additionally the U-shaped guide assembly of the '763 patent is eliminated and a trigger guide assembly is contoured into the cast left and right sections of the pistol to make construction simpler and less expensive.

13 Claims, 8 Drawing Sheets

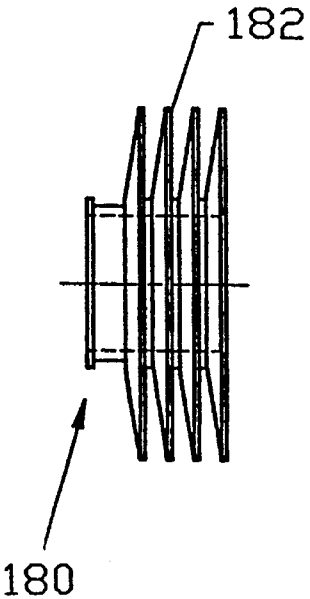
Fig. 9A
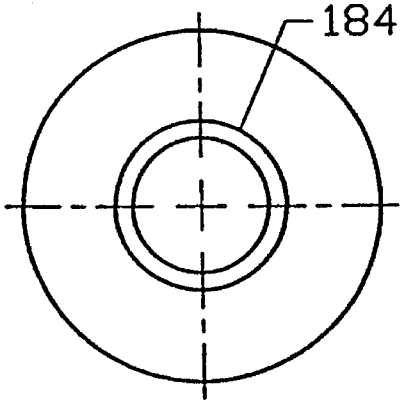
Fig. 9
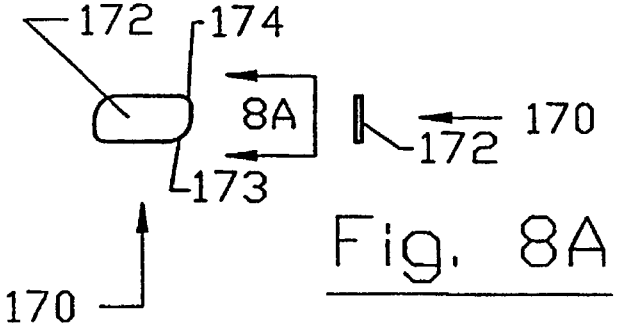
Fig. 8A
Fig. 8

COLLECTOR'S MODEL DISINTEGRATOR PISTOL (CMDF)

This application is a division of application No. 08/144,244 filed Nov. 1, 1993, U.S. Pat. No. 5,389,027.

BACKGROUND OF THE INVENTION

U.S. Pat. No. 2,077,763 discloses a toy gun formed of two complimentary metal stampings held together with five crimped outwardly extending projections.

The metal stampings together define a handle portion, a body portion including a slot for activating a trigger, and an outwardly extending barrel portion housing an air cylinder and a pop mechanism.

Located between the metal stampings is a generally U-shaped guide assembly for a trigger assembly for operating the pop mechanism.

However, the design described in U.S. Pat. No. 2,077,763 has the disadvantage that the metal stampings do not have a classical or collector's item external appearance.

The toy guns according to U.S. Pat. No. 2,077,763 were made with a consreaction whereby the metal stampings were held together with five crimped projections. These projections do not make a classical or collector's item appearance. Furthermore, the crimped projections are less rugged.

The U-shaped guide trigger assembly described in the U.S. Pat. No. 2,077,763 is an expensive member and makes fabrication of the assembly according to the '763 patent unnecessarily complicated and expensive.

SUMMARY OF THE INVENTION

A) Objects of the invention

One object of the present invention is to provide a Collector's Model Disintegrator Pistol (CMDP) which is made of a material which gives a classical, collector's item external appearance.

Another object of the present invention is to provide a method of forming the CMDP with an external appearance of a classical, collector's item.

Another object of the present invention is to provide an improved arrangement for holding the two halves of the pistol assembly together.

Another object of the present invention is to reduce the cost of manufacture of the internal parts of the CMDP by eliminating the guide assembly for the trigger described in U.S. Pat. No. 2,077,763.

Other objects will be apparent from the description and drawings provided herein after.

B) Summary

In accordance with the present invention the foregoing objects are achieved by forming the CMDP from a pair of right side and left side metal castings formed according to the "lost wax" or investment casting process. Preferably the left and fight hand pistol sections are formed of suitable bronze with a wide variety of possible bronze compositions being usable, depending upon cost and desirability of a particular finish.

The bronze left and right sections are held together with counter sunk-screws instead of the crimped projections according to the construction made of the '763 patent.

Additionally the U-shaped guide assembly of the '763 patent is eliminated and a trigger guide assembly is contoured into the cast left and right sections of the CMDP.

THE DRAWINGS

FIG. 8 is a view of the transparent lenses utilized in the flint opening in the present invention.

FIG. 8A is a view looking in the direction of the arrows along the line 8A-8A in FIG. 8.

FIG. 9 is an end view of a cooling assembly utilized in the present invention.

FIG. 9A is a side elevation view of a flint assembly used in the present invention.

DESCRIPTION OF PREFERRED EMBODIMENTS

Figure 1:
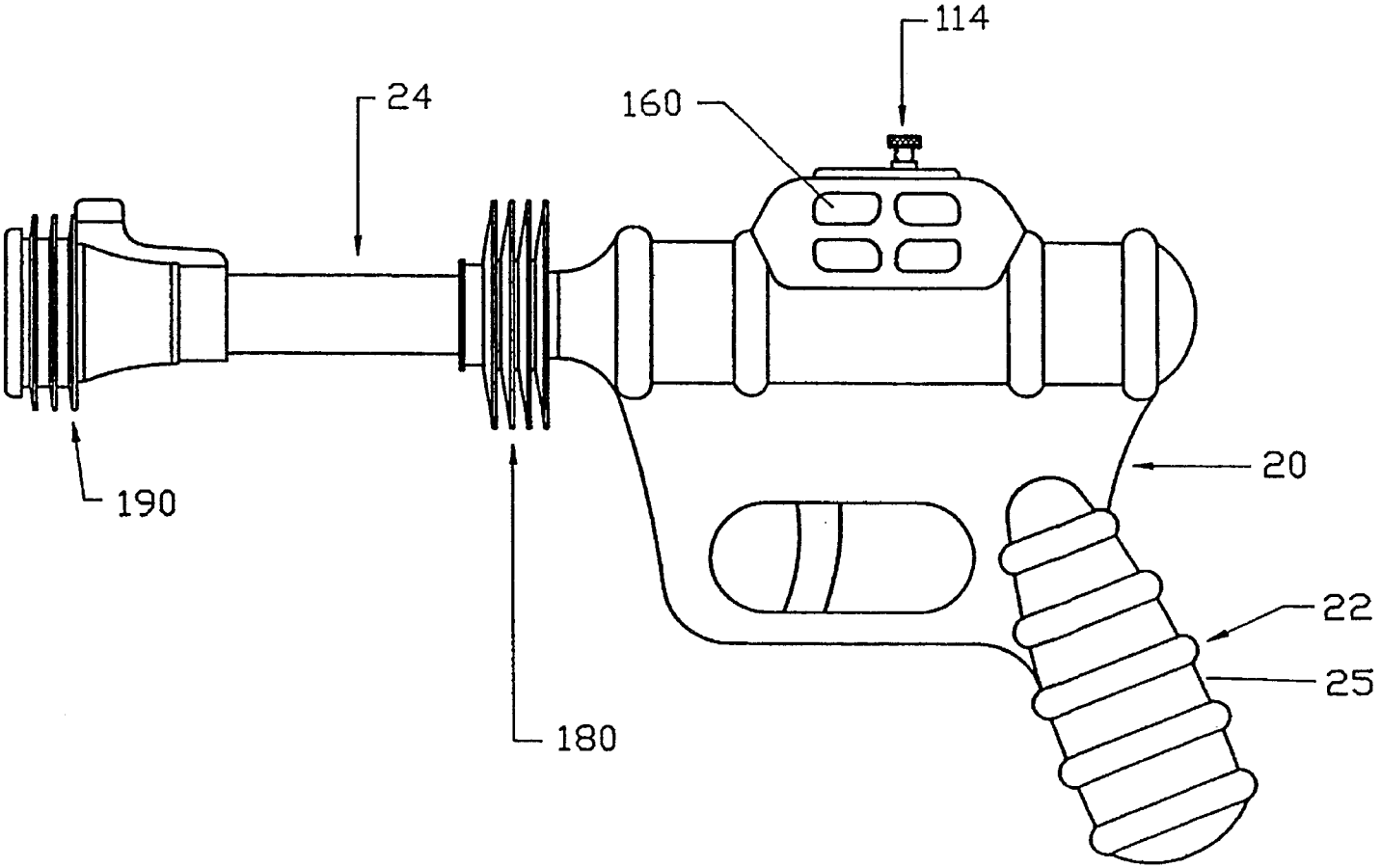
FIG. 1 is a side elevation view partly in sections of the CMDP of the present invention.
Figure 2:
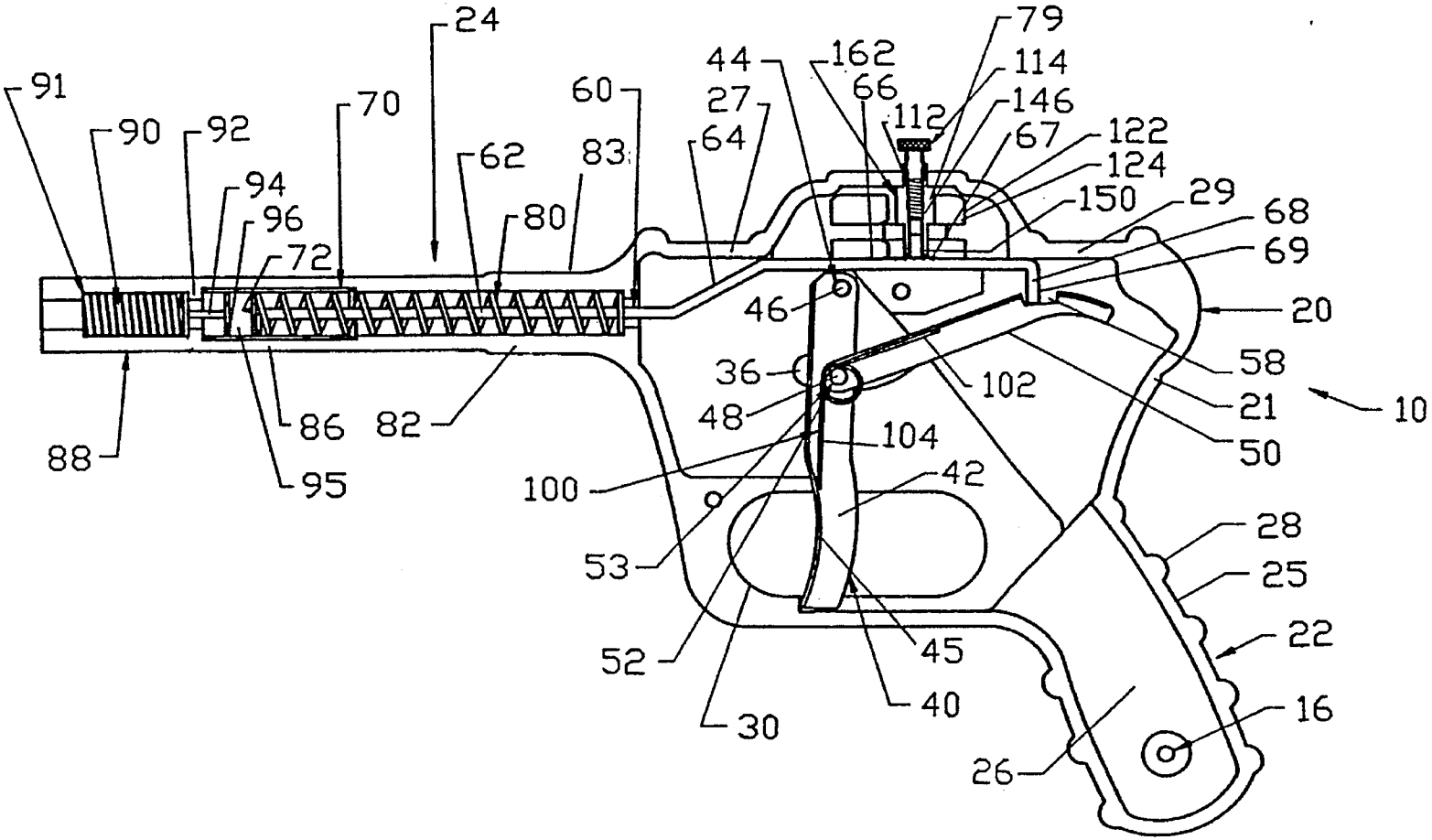
FIG. 2 is a side elevation view of the pistol of the present invention.
Figure 3:
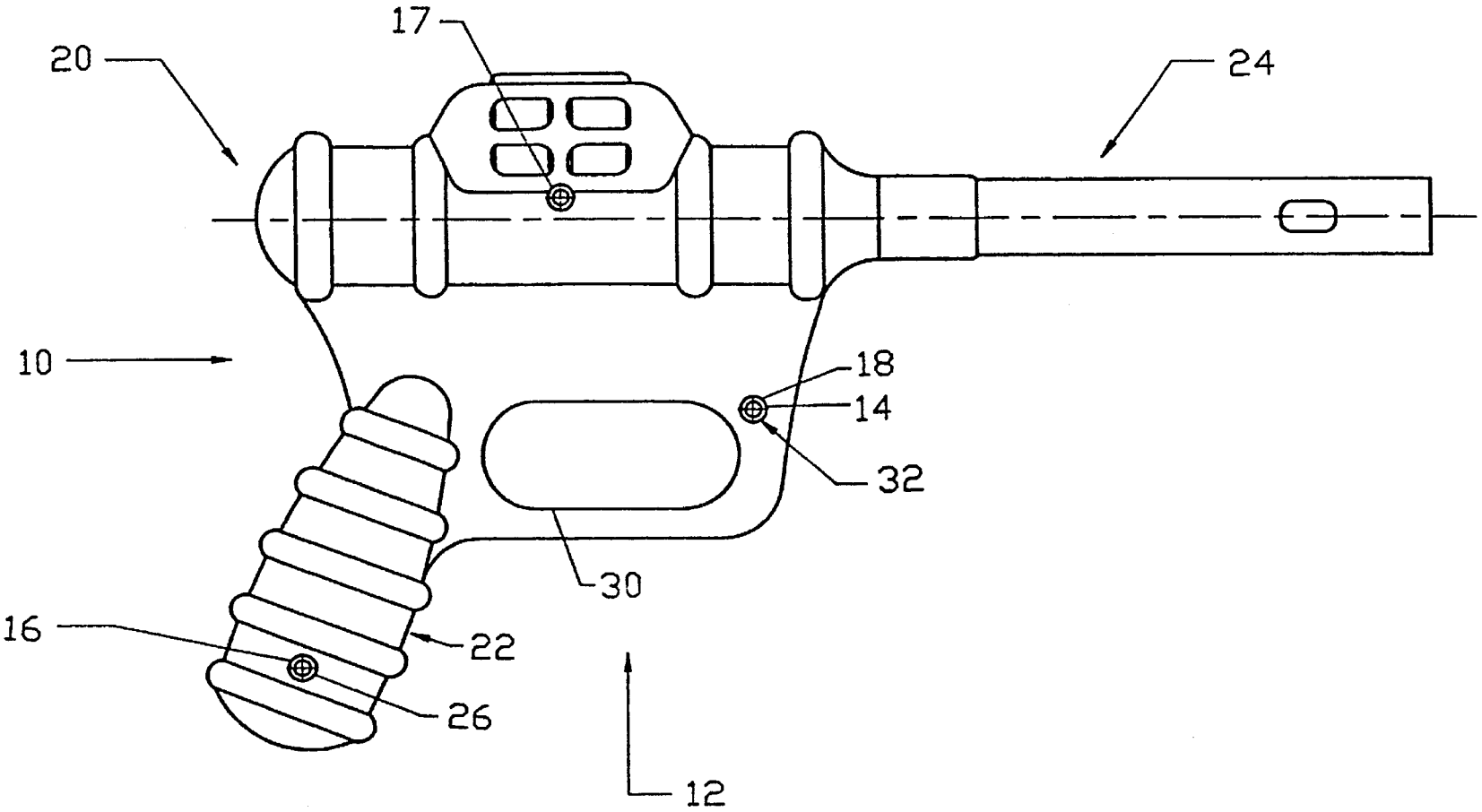
FIG. 3 is a side elevation view of a second half of the pistol of the present invention.

The Collector's Model Disintegrator Pistol (CMDP) is indicated in the drawing Marked FIG. 1 through FIG. 10. The pistol includes a body portion (20), a handle portion (22) and a barrel portion (24). (FIG. 3).

Figure 4:
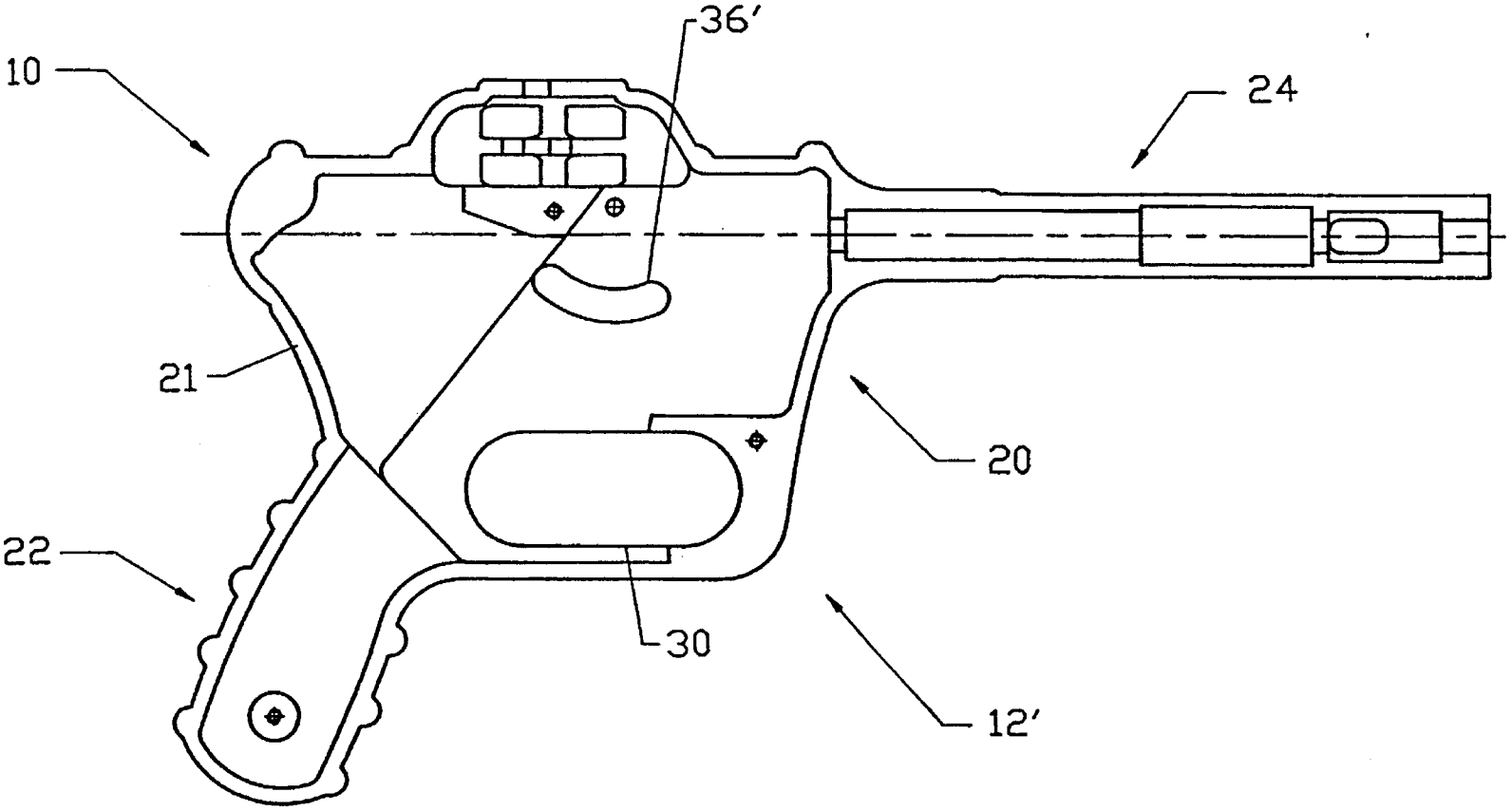
FIG. 4 is a side elevation view partly in sections of the pistol of the present invention.

The handle portion (22), body portion (20), and barrel portion (24) are formed from a pair of cast members formed from the "lost wax" or investment casting process and indicated in the drawings at 12 and 12' respectively, being the right and left members and mirror images of each other. Bronze or other alloys may be used, such as alloys C80100–C87400 of the 1990 MATERIALS SELECTOR, pp. 100–101. (FIG. 3 & 4).

The "lost wax" or investment casting process is a very old, well known casting process for making difficult to form shapes and avoid expensive machining. For example, see A. J. Clegg, *Precision Casting Processes, Pergamon Press, Oxford, N.Y., pp.* 145–173, Copyright 1991; Heine, et al., *Principles of Metal Casting,* 2nd Ed. Copyright 1967, McGraw Hill, pp. 36–41; *Metals Handbooks* 8th Ed., Vol. 5, pp. 237–261, 9th Ed. pp. 253–269; *Lost Wax Process of Casting Jewelry,* Keith Edwards, Copyright 1985, Henry Regnery Co. The process involves production of an expendable (usually wax) pattern. This pattern is a precise component produced from a precision-engineered die. Complex features may be obtained in the pattern by the use of multi-part dies or by the use of soluble wax cores or permanent ceramic cores. The wax patterns are assembled with the gating and feeding system and cleaned prior to their investment with the ceramic coating. This ceramic coating is built up through successive stages of dipping and stuccoing. The initial (primary) dip coat, containing a fine refractory, is allowed to gel before the assembly is dipped in a secondary dip tank and stuccoed with coarser, dry particles in a raining cabinet or fluidized bed. Following gelation of the binder this procedure is repeated until the required shell thickness is obtained. On completion of the gelation stage the expendable wax pattern is removed, preferably in a steam autoclave, and the ceramic shell fared to around 1000 degrees Celsius prior to casting. Pistol halves 12, 12' are so cast.

The fight and left east sections (12, 12') are held together with brass screws (14) extending from one member to the other through openings at 16, 17, and 18. The openings are counter sunk on one end and threaded on the other to achieve an effective fastening arrangement which has a good external appearance. The composition and color of the brass screws preferably matches the composition and color of the bronze casting halves.

The handle portion (22) includes east projections (28) which extend from wall portion (25) formed in each of the left and fight halves. The handle portion is hollow as indicated at 26.

The pistol body portion (20) includes a wall portion (21) again formed from the cooperating left and fight cast pistol halves and includes a cast trigger opening (30) and cam slot (36,36') cast into each of the respective cast halves (12, 12'). (FIG. 2 & 3).

A trigger member (40) is pivotally mounted at 44 upon a transversely extending pin (46). The trigger (40) is channel shaped and includes an arcuate distal end portion (42) for grasping by a finger of the operator. The pin (44) may be threaded into a drilled opening in either or both of the haft members (12, 12'). (FIG. 2).

A link (50) is also channel shaped and is pivotally mounted upon the trigger (40) by means of a dowel pin (52) extending through the opening (53) at one end, and includes a slot (58) near its distal end.

The pin (52) (FIG. 2) moves through opening (48) in trigger (40) within the slot (36, 36') (FIG. 4) formed in the interior of the left and fight members by the casting process. (FIG. 2 & FIG. 4).

A lever spring (100) includes a first leg (102) connected to link (50) and a depending leg (104) adopted to engage the surface (45) of trigger member (40). Spring (100) biases link (50) and trigger (40) into the forward position shown in FIG. 1. (FIG. 2 also).

A piston rod (60) includes a rod portion (62) which extends within a coil spring (80), an inclined portion (64) within body portion (20), a horizontal portion (66) having a cut or rough area (67), and a distal end portion (68) having a downward extension (69) extending into the slot (58). Piston rod (68) may be a stamped or punched metal part. (FIG. 2).

It is to be noted that piston rod (60) engages inner body wall portions (27 and 29) during its back and forth movement through the body portion (20). (FIG. 2).

Piston rod portion (62) extends within a coil spring (80) located in the barrel portion (24). The barrel portion (24) includes a wall portion (82) which is hollow which receives the coil spring (80) and cylinder (70). The cylinder (70) receives a piston head (72) connected in a suitable manner to the piston rod (60) by interference fit or by mechanical fasteners. (FIG. 2).

The wall portion (82) of the barrel (24) is reduced in cross section at 86 to mount the cylinder (70) therein. (FIG. 2).

Furthermore, the cross section of the barrel portion (82) is increased at 88 to receive a spring (90). Spring (90) has a head (92) connected to a piston (94) which in turn is connected to a piston head (96) located within the cylinder (70). (FIG. 2).

Both coil springs (80, 90) are commercially available items. For example, spring (90) may be a CO360-051-125OM. (FIG. 2).

Figure 5:
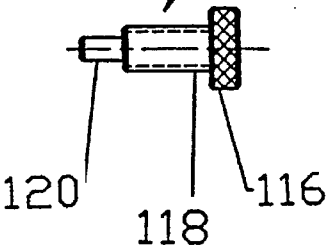
FIG. 5 is a view of the flint knob assembly of the present invention.

A spark (flint) assembly (79) includes an opening (112) in head portion (162) of body portion (20) opening (112) receives a flint knob (114) having a knurled gripping portion (116), a threaded portion (118) and a projecting non-threaded portion (120) of reduced cross section (FIG. 2 and FIG. 5).

Figure 6:
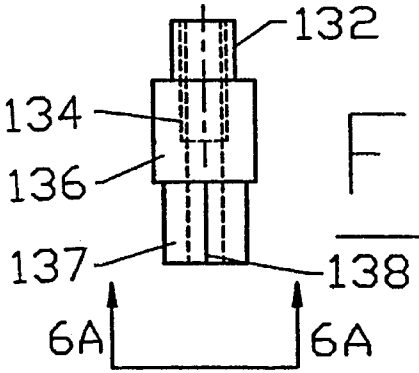
FIG. 6 is a view of the flint housing of the present invention.
Figure 6A:
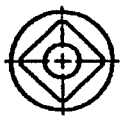
FIG. 6A is a view looking in the direction of the arrows along the line 6A—6A in FIG. 6.

A flint housing (130, FIG. 6) is mounted within a head portion (162) and includes an upward extending hollow threaded portion (132) adopted to receive projecting portion (120), threaded portion (118) of flint knob (114). Threads (134) extend into a housing body portion (136). (FIG. 6).

An unthreaded downward extending portion (137) includes an opening (138). A flint pusher (140) includes a upwardly extending portion (142) adopted to extend into housing (138) and engage the lower portion of a spring (146) mounted within housing (130). Spring (146) may be purchased item C0088-012-0620M. (FIG. 2, 6, & 7).

Spring (146) is held captive between the depending portion (120) of knob (114) and upwardly extending portion (142) of flint pusher (140). Flint pusher (140, FIG. 7) engages the flint (150) to force it into the engagement with the cut and rough portion (67) of piston rod (60) as piston rod (60) moves from right to left after spring (80) is released. (FIG. 2, 5 & 7).

It is to be noted that the guide portion for the movement of piston rod (60) is formed by cooperating services of the cast halves (12, 12'). Thus the pin (52) moves within opposed slots (36, 36') formed in the two halves (12, 12'). Piston rod portion (66) moves along the surfaces (27, 29) of body portion (20). Thus the need for a separate guide assembly for piston rod (60) is avoided in the present invention. (FIG. 2).

Openings (160) are provided in the head portion (162). Translucent members (170) including spark lens members (172) having contoured comers (173, 174, FIG. 8) are held within the openings (160) by means of a suitable adhesive such as glue or with mechanical fasteners. Thus, when the piston rod (60) moves against the flint (150) and the spark ignites, the spark will be viewable through the translucent members (170) located in openings (160). (FIG. 2, 8).

A cooling fin assembly (180, FIG. 9 and 9A) includes a plurality of tapered thin members (182) extending outward from a circular wall portion (184) which integrally engages the barrel portion (24) at portion (83). Cooling fin assembly (180) is conveniently made of aluminum or magnesium alloy, see 1990 MATERIALS SELECTOR pp. 78–87 and 106–109; and may be either diecast or extruded as single piece for economy of production. It may be shrunk to achieve an integral connection with barrel body portion (83) or a suitable adhesive may be used such as Lock-Tite. (FIG. 1, 2, 9 and 9A).

A second cooling fin assembly (190) is provided (FIG. 10 and 10B) including tapered fin members (192) extending out from a fin body portion (194). Cooling fin assembly (190) may also be made of aluminum, magnesium, or alloy and may be diecast or extruded. See MATERIALS SELECTOR supra.

Figure 10A:
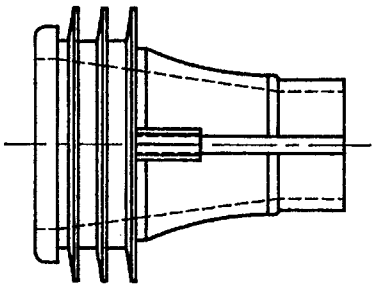
FIG. 10A is a top view of FIG. 10 in accordance with the present invention.
Figure 10:
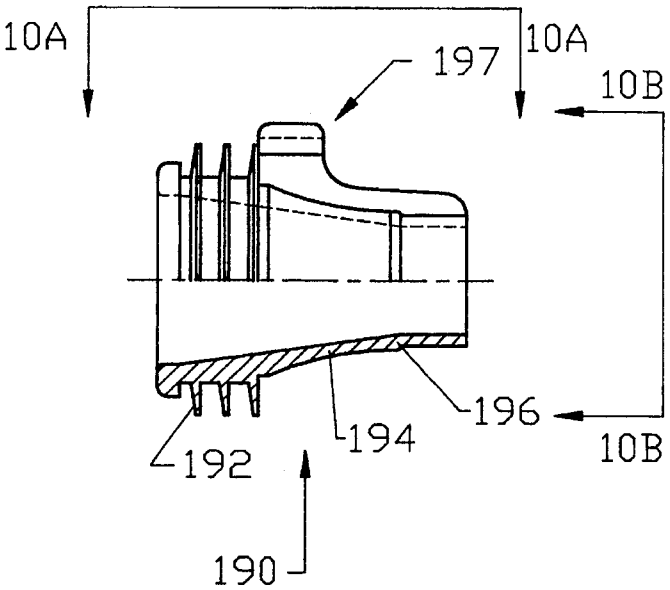
FIG. 10 is a side elevation view partly in section of the outermost cooling assembly of the present invention also including a sight in accordance with the present invention.

The cross-sectional area of the body portion (194) becomes reduced as indicated at (196) to facilitate attachment of the cooling assembly to the portion (88) barrel (24). (FIG. 2 and 10).

Figure 10B:
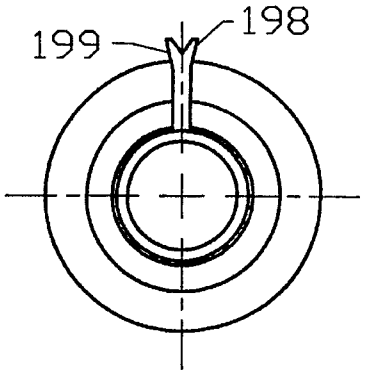
FIG. 10B is an end view of FIG. 10 in accordance with the present invention.

A projection (197) is formed in cooling assembly (190) and contoured as indicated in FIG. 10B having opposed sides (198, 199) to form a sight. (FIG. 10).

Figure 7:
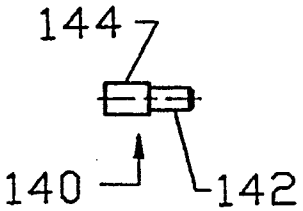
FIG. 7 is a view of the flint pusher of the present invention.
Figure 7A:
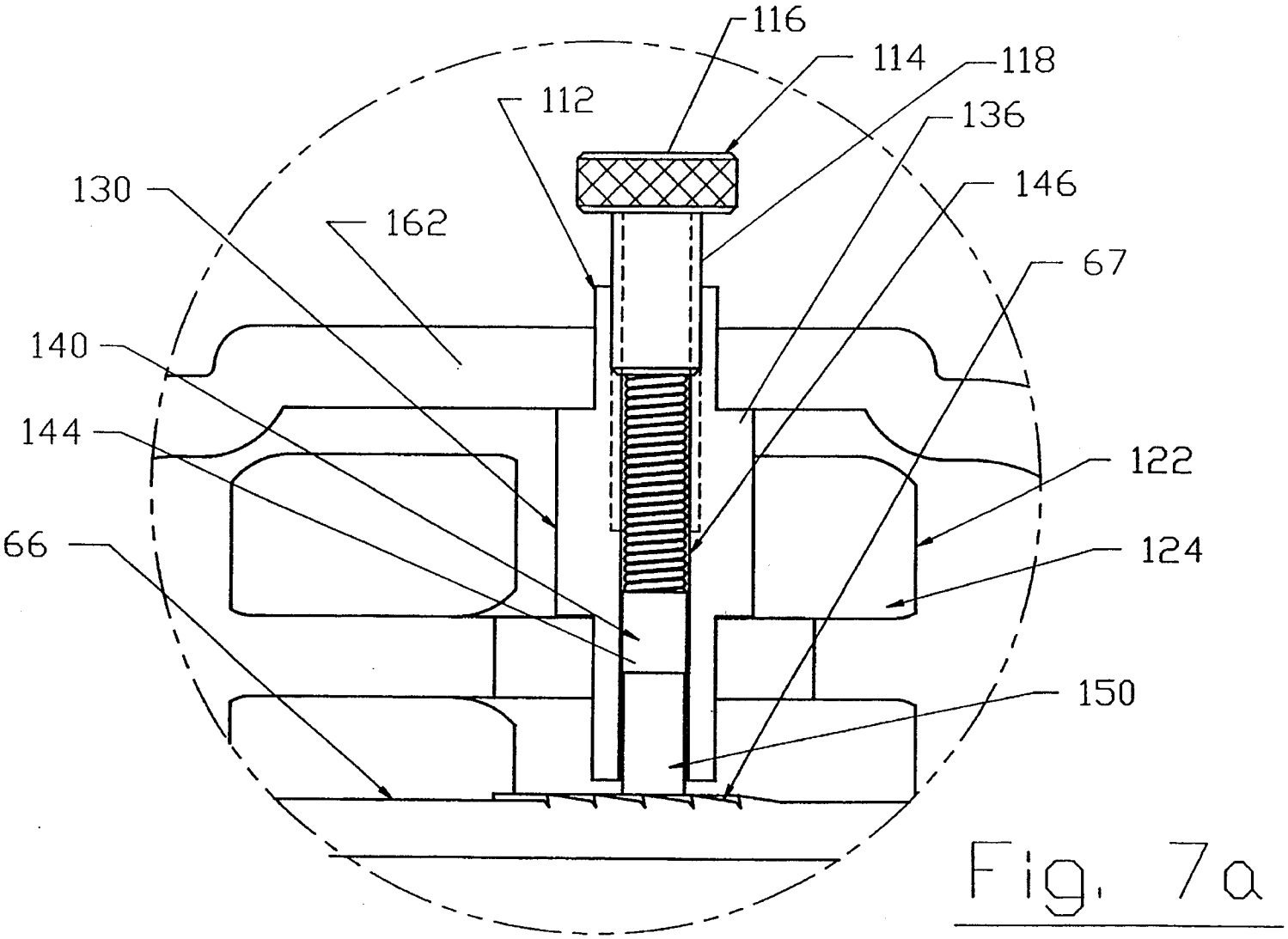

In operation to install the flint, the knob (114) is rotated to remove the knob (114), spring (146), and the flint pusher (140). The flint (150) is then placed upon the piston rod portion (67). Then the spring (146) is reinserted located between the flint pusher (140) and the flint knob (114). The flint knob is rotated to provide suitable pressure to maintain the flint in engagement in the rod portion (67). As the flint (150) is worn, pressure may be maintained by further rotation of knob (114). (FIG. 5 and 7).

In order to operate, grasp the handle portion (22), insert finger through opening (30), pull upon the trigger member (40) causing it to pivot about the pin (46), move the pin (52) along the slot (36), moving link (50) from left to right sufficient to move the slot (58) and the downward extension (69) from left to right in FIG. 2. This movement of rod (60) is opposite to the bias of spring (80) and also opposite to the bias spring (102). This movement of piston rod (60) occurs with respect to fixed cylinder (70). This movement continues until the trigger (40) forces the link (50) sufficiently far to the right that the projection (69) is moved out of the slot (58). When this occurs, the piston rod (60) then under the bias of the spring (80) moves rod (60) from fight to left very rapidly. During fight to left movement of the piston rod (60) the stationary flint (150) engages the cut and/or roughened potion (67) of the piston rod and causes a spark to occur. This spark is viewable through the translucent members (172) in the viewing assembly (160). (FIG. 2 & 8).

The fight to left movement of rod (60) causes air compressed within the cylinder (70) to escape from the cylinder (70), and piston head (72) abuts piston head (96), causing a "pop". (FIG. 2).

The action of the piston (60) is cushioned by the spring assembly (90) when the head (96) engages the piston head (63). This depresses the spring (91) which acts as a cushion for the piston (60). (FIG. 2).

Spring (100) causes trigger (40) and link (50) to return to their original position. When this occurs projection (69) again engages the slot (58) in link (50) to allow repeating of this procedure. (FIG. 2).

The cooling fin assemblies (180, 190) do not function significantly to cool the assembly because there is not sufficient real heat generated in this pistol. These assemblies are primarily provided for decoration and simulation of actual pistol firing.

The use of the "lost wax" or investment casting process to form the housing halves (12, 12') of the pistol allows the construction of an attractive classical, outer finish of the pistol depending on alloy composition. The use of counter sunk screws (16, 17, 18) provides an attractive and effective method of holding the assembly together. The use of the pistol halves (12, 12') to form the guiding assembly for the action of piston rod (60) including the slot (36, 36') and the surfaces (27, 29) of the body portion represents a significant improvement over the construction shown in U.S. Pat. No. 2,077,763, since the expensive guiding element has been eliminated in accordance with the present invention. (FIG. 2 and 3).

What is claimed is:

1. A method of forming a toy sparking pop gun pistol comprising:

forming a wax pattern in the shape of a pistol including a pair of mirror image halves defining a hollow handle portion, hollow body portion, and a hollow barrel portion having a distal end;

forming a head portion above said body portion;

forming at least one trigger opening in each body portion half;

forming a flint opening within said head portion.

forming a trigger opening with the pattern;

forming at least one spark opening in the pattern;

forming opposed slots within said body portion;

detailing an external surface of each pistol half;

applying a ceramic coating to said mirror image halves;

placing each of said mirror image halves in an investment mold;

heating said was pattern sufficiently to vaporize and remove each said pattern from each mold;

pouring a molten alloy into each mold to form cast mirror image half sections of said pistol;

removing the thus investment cast mirror image halves from the molds;

assembling said mirror image half sections together to form said pistol;

providing shoulder means in said barrel portion of said halves to house a rod resilient means and a cylinder within said barrell;

separately forming a generally elongated trigger member and a generally elongated link member having a rod engagement slot;

assembling said trigger member in a vertically orientated position extending downwardly between said cast half body portions so that the the trigger is located between said formed slots in said body portion;

placing a dowel pin through an opening in the trigger member and extending into said opposed slots, and attaching said link and said trigger member so that said link extends rearwardly and inclines upwardly in said body portion;

separately forming a piston rod having a piston head, a rod body portion, a horizontal portion having a roughened surface and a distal end having a downwardly extending projection;

locating said piston rod within said barrel;

locating a separately formed resilient means within said barrel engaging said positioned;

locating a separately formed cylinder within said barrel; and placing the piston rod into the cylinder;

placing flint material within said flint opening within said head portion;

locating said distal end of said piston rod within the body portion of the pistol and extending into said rod engagement slot in said link; connecting the pistol half sections together with fastening means whereby when an operator grasps the trigger member, the trigger member and the link may be moved rearwardly against the bias of the resilient means, with the body portion of the pistol guiding the piston rod until such time as the distal end of the piston rod slips out of the rod engagement slot, whereby the piston rod moves rapidly forwardly under the bias of said rod resilient means, creating a high pressure surge in said cylinder; said roughened portion of the piston rod engages said flint material and a spark ignites within said head portion; and wherein said piston rod created pressure surge escapes around a cylinder obstruction means within said cylinder causing an audible pop.

2. A method according to claim 1 including separately forming a resilient means and assembling said resilient means in said pistol forward of said cylinder, said resilient means engaging a second piston rod within said barrel, locating said second piston rod within said cylinder a spaced distance from said first piston head, whereby when said first piston rod engages said second piston rod, said second resilient means cushions the movement of said first piston rod.

3. A method according to claim 1 wherein the pattern includes written descriptive material relative to said pistol.

4. A method according to claim 22 wherein gripping projections are formed in the pattern halves of said handle portions.

5. A method according to claim 4 wherein the pattern of said barrel portions includes shoulders to facilitate assembly of said barrel resilient means, said cylinder, and said second resilient means.

6. A method according to claim 1 wherein the pattern of said body portion in each half includes generally horizontal portions adopted to guide said piston rod in its back and forth movement within said body portion and said barrel.

7. A method according to claim 1 including forming at least one simulated cooling assembly and locating said cooling assembly upon said barrel.

8. A method according to claim 1 including forming a sight and locating said sight at the distal end of the barrel portion.

9. A method according to claim 8 wherein a second simulated cooling assembly is separately formed and is positioned upon the distal end of said barrel portion.

10. A method of claim 9 wherein said sight is formed integral with said second simulated cooling assembly and is applied to said barrel assembly.

11. A method according to claim 1 including forming separately a flint housing inserting a flint within said opening and said head portion; removably inserting said flint housing whereby to hold said flint in engagement in said piston rod roughened portion.

12. A method according to claim 11 wherein said flint housing includes a knurled knob and wherein said neural knob is utilized to move said flint into engagement with said roughened portion as said flint is used up in operation.

13. A method according to claim 12 including providing a spring within said flint housing which engages said knob and said flint to urge said flint in continuance engagement with said roughened portion.

* * * * *